US006766989B2

(12) United States Patent
Liu

(10) Patent No.: US 6,766,989 B2
(45) Date of Patent: Jul. 27, 2004

(54) LIFTED UPRIGHT POST DEVICE WITH MULTIPLE JOINTS

(76) Inventor: Yu-An Liu, No. 34, Alley 31, Lane 647, Sec. 6. Chung-Hua Road, Hsinchu (TW)

( * ) Notice: Subject to any disclaimer, the term of this patent is extended or adjusted under 35 U.S.C. 154(b) by 0 days.

(21) Appl. No.: 10/310,460

(22) Filed: Dec. 4, 2002

(65) Prior Publication Data

US 2003/0173472 A1 Sep. 18, 2003

(30) Foreign Application Priority Data

Mar. 18, 2002 (TW) ..... 91203292 U

(51) Int. Cl.[7] ..... A47F 5/00
(52) U.S. Cl. ..... 248/125.2
(58) Field of Search ..... 248/125.2, 125.3, 248/132, 161, 157; 52/361, 364, 365, 64; 312/4

(56) References Cited

U.S. PATENT DOCUMENTS 6,167,665 B1 * 1/2001 Dame et al. ..... 52/239
6,267,525 B1 * 7/2001 Wu ..... 403/49
6,349,516 B1 * 2/2002 Powell et al. ..... 52/239
6,493,995 B2 * 12/2002 McKenzie ..... 52/36.4
2003/0039507 A1 * 2/2003 Liu

* cited by examiner

*Primary Examiner*—Ramon O. Ramirez
(74) *Attorney, Agent, or Firm*—Law Office of John Chupa, P.C.

(57) ABSTRACT

A lifted upright post device with multidirectional joints includes at least one upright post and a lifted device. The upright post is elongated with a homogeneous cross section, having longitudinal engaging slide grooves disposed at a circumferential periphery thereof and each of the slide grooves has an outer opening to communicate with the outside. The lifted device is selectively disposed in the slide grooves with a slide part being connected to a spacing board. Once the lifted device is actuated, the slide part can move upward or downward in the slide grooves longitudinally so as to move the spacing board synchronously.

12 Claims, 5 Drawing Sheets

LIFTED UPRIGHT POST DEVICE WITH MULTIPLE JOINTS

BACKGROUND OF THE INVENTION

1. Field of the Invention

The present invention relates to a lifted upright post device with multidirectional joints, and, particularly to a lifted upright post device, in which at least a lifted device is provided so as to lift or descend a spacing board connected to the lifted device.

2. Description of Related Art

Due to fast development of the industrial and the commercial businesses and the population aggregating in the city, we have confronted an extreme challenge with regard to a limited living space and office space. Besides, increasing frequencies of moving and temporary space needs make the traditional stationary partition or screen system unavailable for meeting the necessity. Thus, the so-called flexible partition or screen system arises at the right time.

Because the partition system or the screen system is lack of openness and mobility, it is getting declining along with the change of job style and a screen system emphasizing opening space is used instead. Although the screen system available in the market provides sight obstacle less environment and an office can be partitioned as several semi-opening rooms as long as several worktables are assorted with the conventional screen system, the deficiency of the conventional screen system is it is unmoved so that it is incapable of being adjustably lifted as the actual need. Besides, the upright post in the screen system mostly can be continuously extended transversely, but L shaped, T shaped or cross-shaped switch upright posts have to be prepared for making turns. In order to meet the necessity of corner turns, the fabrication and the inventory for more upright posts are required such that the expenditure of additional molding tools has to be increased largely and the structure of the product becomes more complicated.

In order to improve the conventional screen system, the present inventor has filed U.S. patent application Ser. No. 09/838,302 now U.S. Pat. No. 6,612,670 entitled LIFTED SCREEN and U.S. patent application Ser. No. 10/002,228 now U.S. Pat. No. 6,634,824 entitled CONNECTING DEVICE FOR A SCREEN SYSTEM. The present inventor has aimed at the preceding deficiency and develops the invention.

SUMMARY OF THE INVENTION

An object of the present invention is to provide a lifted upright post device with multidirectional joints, in which the upright post can be joined vertically or transversely optionally and at least a lifted device is arranged in each of the upright posts in a screen system so that it is possible to be lifted or descended along the desired direction with spacing boards therein moving synchronously.

In order to reach the preceding object, the lifted upright post device with multidirectional joints according to the present invention includes at least one upright post and a lifted device. The upright post is elongated with a homogeneous cross section, having longitudinal engaging slide grooves disposed at a circumferential periphery thereof and each of the slide grooves has an outer opening to communicate with the outside. The lifted device is selectively disposed in the slide grooves with a slide part being connected to a spacing board. Once the lifted device is actuated, the slide part can move upward or downward in the slide grooves longitudinally so as to move the spacing board synchronously.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
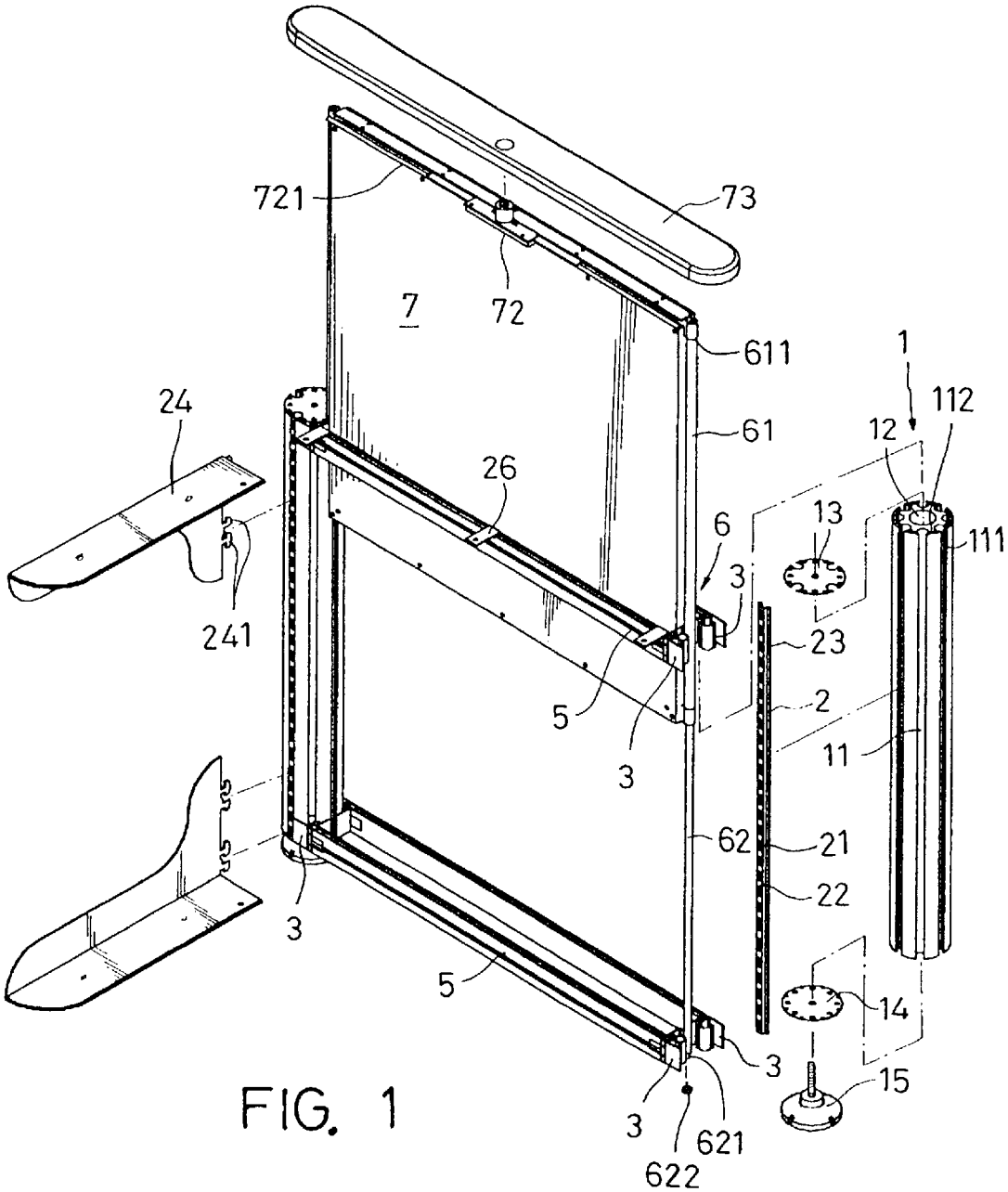
FIG. 1 is an exploded perspective view of an upright post and a lifted device according to the present invention.
Figure 2:
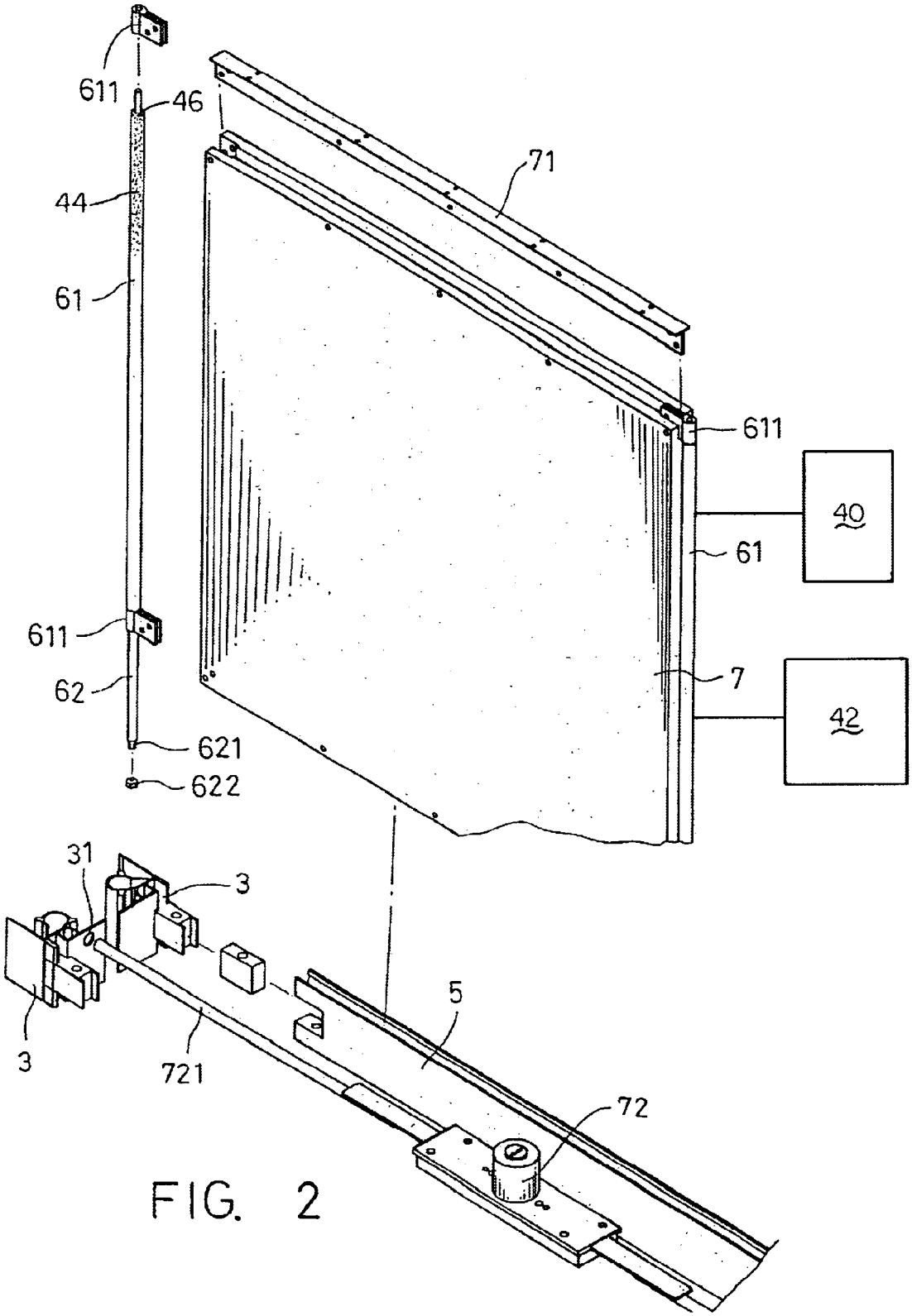
FIG. 2 is an exploded perspective view of relay stuffs, spacing board and the lifted device according to the present invention.
Figure 3:
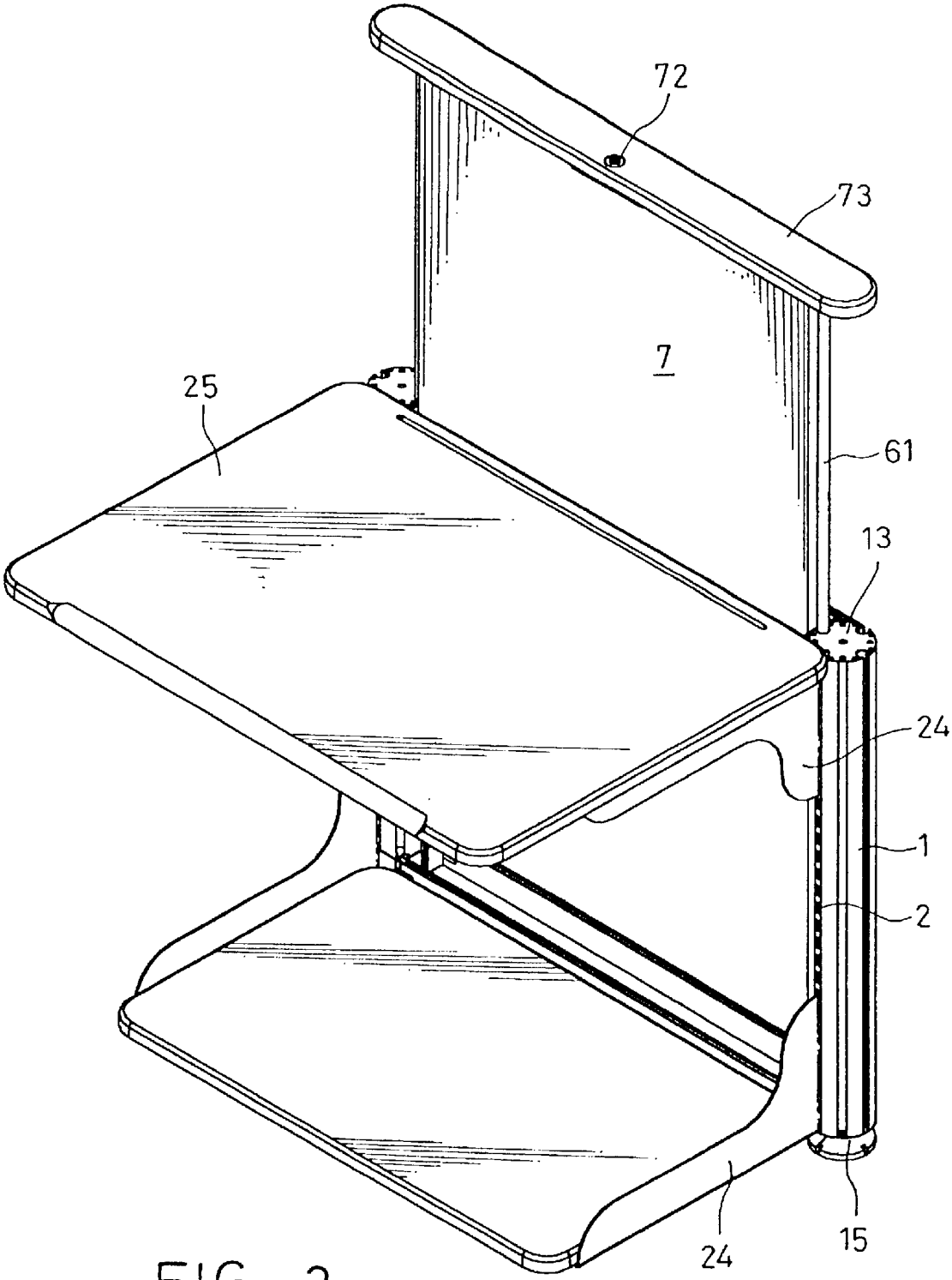
FIG. 3 is a perspective view of a modularized table unit composed of lifted upright posts of the present invention.
Figure 4:
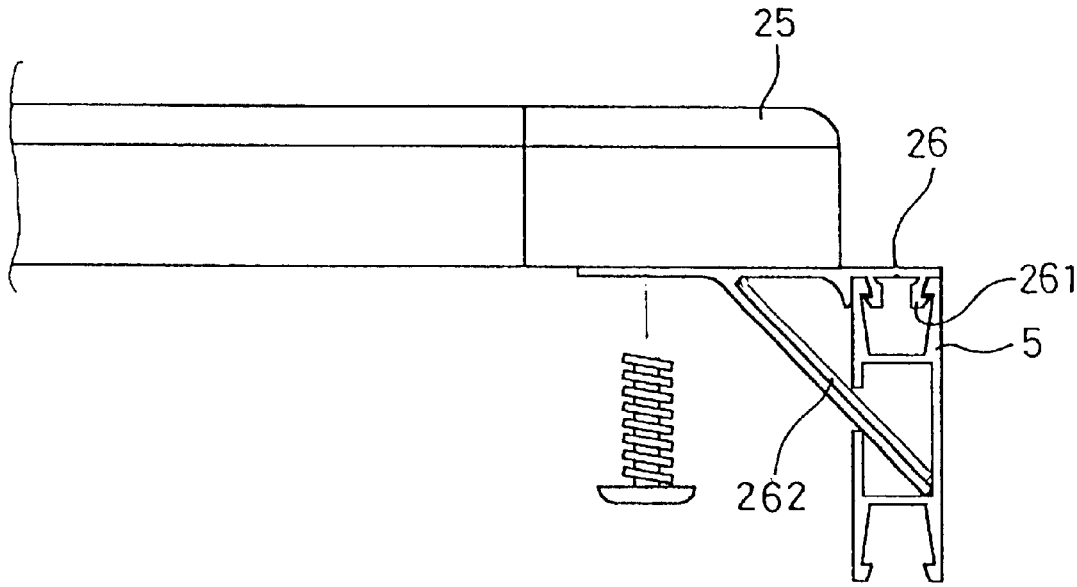
FIG. 4 is a plan view illustrating a table board with a lower joint piece for engaging with a relay stuff in the present invention.

Referring to FIGS. 1 and 2, a lift upright post device with multidirectional joints according to the present invention comprises an upright post 1, a lifted device 6 and a spacing board 7.

Wherein, the upright post 1 is elongated with homogeneous cross section and the periphery thereof has a plurality of engaging slide grooves 11 with an outer opening 111 along each of the slide grooves 11. In fact, the upright post 1 basically is the same as that disclosed in U.S. patent application Ser. No. 10/002,228 filed by the present inventor so that it is mentioned here as a reference. That is, each of the engaging slide grooves 11 at two inner lateral sides thereof has a side groove 112 respectively so as to be inserted with and locate two side juts 23 of an insert bar 2 such that a front arctic projection 21 thereof can be located at the outer opening 111 with a line of equidistantly longitudinally disposed hanging holes 22.

Besides, the upright post 1 at the upper and the lower ends thereof has two opposite lock pins 3 inserted in two of the engaging slide grooves 11 and a relay piece 5 is connected to each of the lock pins 3 and the corresponding lock pin 3 in a neighboring upright post 1 to form a frame. Thus, a panel board can be held by the relay pieces 5 (not shown) to form a screen.

Further, the upright post 1 at the center thereof is provided with an axial through hole 12 for being passed by wires and the upper and the lower ends thereof are attached with a top end piece 13 and a bottom end piece 14 to block the openings thereon. An adjustable leg 15 is connected to the bottom of the upright post 1 so that the upright post 1 can be adjusted the elevation thereof.

The lifted device 6 is a sleeve type extension device such as an air cylinder 40 or a hydraulic cylinder 42 or a cylinder associated with a sleeve 46 a spring 44 and a lever. As shown in FIGS. 1 and 2, the lifted device 6 is a cylindrical pipe (slide part) fitting with a lever (stationary part) 62, which is received in one of the engaging slide grooves 11 between another two of the engaging slide grooves 11 attached with the lock pins 3. The lever 62 at the lower end thereof is a fixing end 621, which passes through the bottom end piece 14 and is fastened with a nut 622 to form a stationary part.

The cylindrical pipe 61 at the upper and the lower ends thereof has a pivot 611 joined to the spacing board 7 such that it is possible that the spacing board 7 can be lifted or descended with cylindrical pipe 61 along the engaging slide groove 11.

The spacing board 7 is disposed and taken in a frame enclosed by two upright posts. In practice, the spacing board 7 can be a writing board such as an electronic whiteboard, a display panel or an illumination panel so that characters or pictures can be shown on the board or an effect of illumination can be performed. Besides, the spacing board 7 can be applied to a counter in a bank or a commercialized counter or used for a dressing table in a beauty salon as a lifted mirror.

In order to protect the upper and the lower sides of the spacing board 7, a T shaped edge sealing plate 71 can be used as a side cover respectively. The upper side thereof is provided with a lock 72 and the lock 72 extends laterally a key plug 721 to engage with a preset engaging hole 31 in the respective engaging pin 3 such that the spacing board 7 can be fastened firmly and it becomes unable to be lifted. Once the lock 72 is unlocked, the cylindrical pipe 61 is free from being caught and moves upward along the engaging slide groove 11 to allow the spacing board 7 lifting synchronously so as to attain an expected effect. Further, an upper cover 73 can be connected to the upper side of the spacing board 7 for a purpose of beautification.

Figure 5:
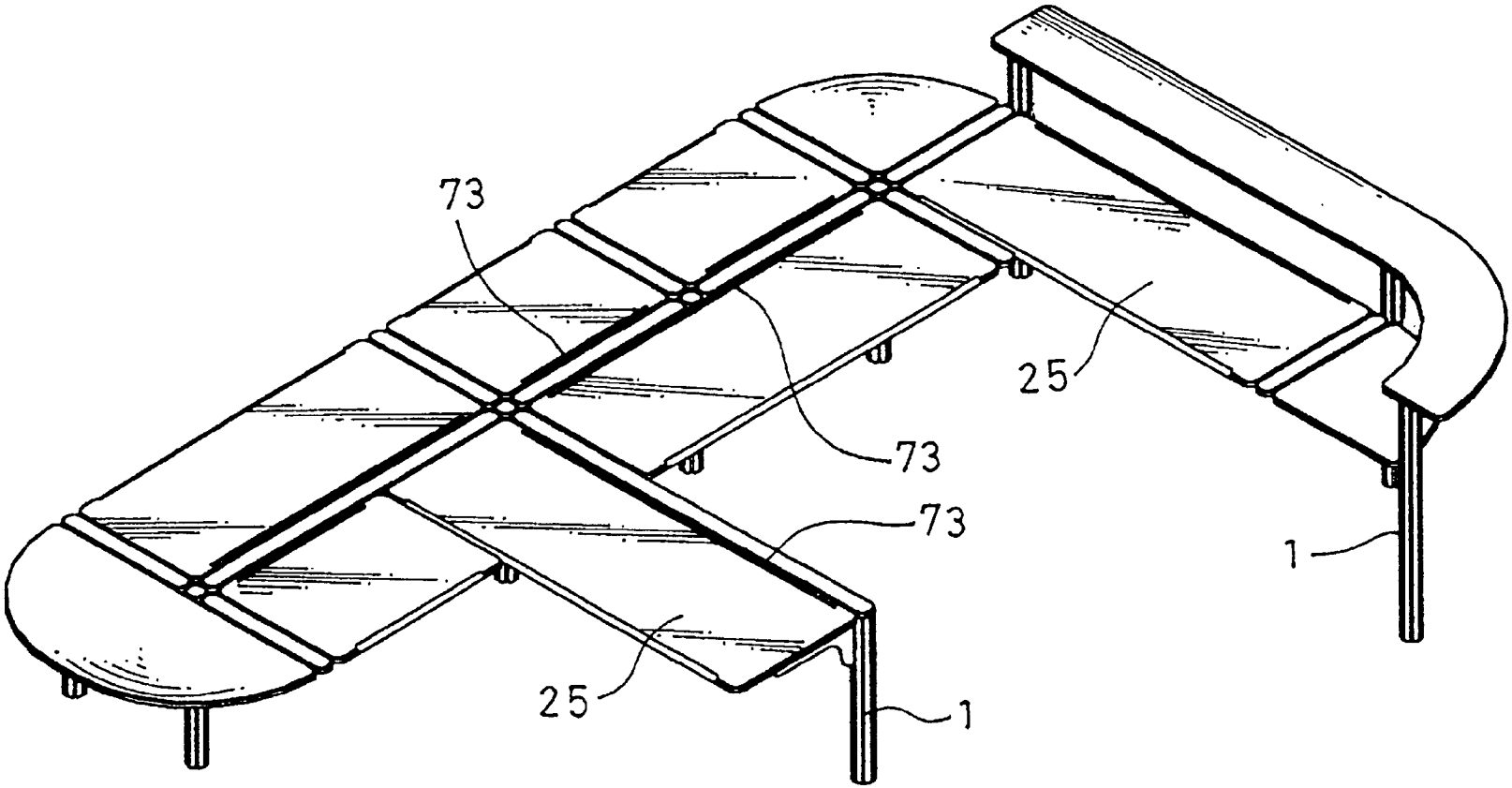
FIG. 5 is a perspective view illustrating an office furniture system set up by way of the lifted upright posts of the present invention.

Referring to FIGS. 1 to 4 again, in order to form a table, two brackets 24 with tenons thereof are engaged to corresponding hanging holes 22 in the two insert bars 2 such that the table board 25 can be placed on the two spaced apart brackets 24 to constitute a firmer connection with the relay piece 5 with a forked upper joining piece 26 at an end thereof having hooks 261 to engage with the relay piece 5. Further, the upper joining piece 26 at a lateral side thereof extends a stretch plate 262 to be inserted into the relay piece 5 and a screw passes through the upper joining piece 26 so as to be fastened to the table board 25 so that the table board 25 can be effectively supported in place horizontally. As soon as the table is set up, the configuration thereof is as shown in FIG. 5. Besides, in order to set up an open type office system furniture as shown in FIG. 5, a plurality of upright posts 1 and table boards 25 can be used to be associated with each other. Moreover, once the spacing board 7 is lifted, a screen system can be formed. Further, a conference room or private space can be formed without any sight obstacle based on the actual need as desired.

It is appreciated that the advantages of the present invention are listed hereinafter:

1) The lifted upright post device with multidirectional joints of the present invention can be assembled fast and located accurately. Due to all parts thereof having been designed with modularization and the parts being fixed by way of insertion, the upright post device is possible to be set up fast and flexibly to reach the best effect during the assembly job being performed.
2) The lifted upright post device with multidirectional joints of the present invention provides a function of multiple direction stretching. The upright post is specially designed so that it is possible to have a function of performing multiple direction extensions easily under a condition of not switching the upright post.
3) The upright post device with multidirectional joints of the present invention has a function of extending the spacing board thereof so that the spacing board can be selectively lifted to form a screen system or an open space so as to offer a communication environment for human relationship.
4) The upright post device with multidirectional joints of the present invention can be detached or assembled easily. The purpose for lifting and descending the spacing board can be reached even if the parts thereof are simply fabricated. Further, the parts can be reused over and over again after being detached so that the pursuit of environmental protection can be actually achieved.

While the invention has been described with reference to a preferred embodiment thereof, it is to be understood that modifications or variations may be easily made without departing from the spirit of this invention, which is defined in the appended claims.

What is claimed is:

1. A lifted upright post device with multidirectional joints, comprising: at least one upright post, being elongated with a homogenous cross section, having a plurality of longitudinal engaging slide grooves being disposed at a periphery thereof circumferentially and each of the slide grooves having an outer opening to communicate with the outside; and a lifted device, being selectively disposed in the slide grooves with a slide part being connected to a spacing board; whereby, once the lifted device is actuated, the slide part thereof can move upward or downward in the slide grooves longitudinally so as to move the spacing board synchronously.

2. The lifted upright post device with multidirectional joints according to claim 1, wherein each of the slide grooves at two opposite sides thereof having a section of side groove respectively and an insert bar with two side juts is joined to the side grooves; and the insert bar has a front arctic projection edge to be located at the opening of each of the slide grooves with a plurality of lined up hanging holes.

3. The lifted upright post device with multidirectional joints according to claim 1, wherein another upright post is disposed near the upright post and the respective upright post at an upper and a lower ends thereof is inserted with a lock pin in one of the slide grooves opposite to each other and a relay piece if connected to two opposite lock pins to form a frame.

4. The lifted upright post device with multidirectional joints according to claim 1, wherein the upright post has an axial elongated through hole.

5. The lifted upright post device with multidirectional joints according to claim 1, wherein the upright post at the upper and the lower ends thereof connects with a top end piece and a bottom end piece and the bottom end piece has a lower adjustable leg.

6. The lifted upright post device with multidirectional joints according to claim 1, wherein the lifted device is comprised of an air cylinder, a hydraulic cylinder or a sleeve, a spring and a lever.

7. The lifted upright post device with multidirectional joints according to claim 6, wherein the slide part of the lifted device is a cylindrical pipe fitting with the lever, which are received in one of the slide grooves.

8. The lifted upright post device with multidirectional joints according to claim 7, wherein the lever at a lower end thereof is fixed to the lower end of the upright post and both ends of the cylindrical pipe is attached with a pivot to connect with the spacing board.

9. The lifted upright post device with multidirectional joints according to claim 8, wherein the spacing board is a flat board, a writing board, a display panel, an illumination panel, a flat mirror or a spacing board composed of at least two of said flat boards.

10. The lifted upright post device with multidirectional joints according to claim 1, wherein the spacing board at an upper side thereof has a lock with a lateral key plug to engage with an engaging hole in one of the engaging pins so that the spacing board can be in a state of being lock or unlocked depending on controlling the lock.

11. The lifted upright post device with multidirectional joints according to claim 10, wherein the spacing board at the upper side thereof may have a cover to hide the lock.

12. The lifted upright post device with multidirectional joints according to claim 1, wherein said at least one upright post comprises at least two upright posts, and wherein a table board is disposed between said at least two upright posts and the table board at the lower side thereof is joined to at least a forked support piece with an end thereof having hooks for holding the relay piece and at a middle section thereof extending an inclining stretch plate for being inserted into the relay piece so that the table board can be supported.

* * * * *